US006850143B2

(12) United States Patent
Naito et al.

(10) Patent No.: US 6,850,143 B2
(45) Date of Patent: Feb. 1, 2005

(54) FLYBACK TRANSFORMER

(75) Inventors: Kenji Naito, Shiga-ken (JP); Hisashi Takiguchi, Omihachiman (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 185 days.

(21) Appl. No.: 10/190,581

(22) Filed: Jul. 9, 2002

(65) Prior Publication Data

US 2003/0020582 A1 Jan. 30, 2003

(30) Foreign Application Priority Data

Jul. 23, 2001 (JP) ..... 2001-221052

(51) Int. Cl.[7] ..... H01F 27/30
(52) U.S. Cl. ..... 336/198; 336/221; 336/225
(58) Field of Search ..... 336/90, 92, 98, 336/192, 198, 220–225

(56) References Cited

U.S. PATENT DOCUMENTS 4,499,522 A * 2/1985 Nakamura ..... 361/836

FOREIGN PATENT DOCUMENTS

| | | | |
|---|---|---|---|
| JP | 61-40014 | * | 2/1986 |
| JP | 11-260574 | * | 9/1999 |
| JP | 2003-133151 | * | 5/2003 |

* cited by examiner

*Primary Examiner*—Tuyen T. Nguyen
(74) *Attorney, Agent, or Firm*—Keating & Bennett LLP

(57) ABSTRACT

A flyback transformer has a winding portion. The winding portion includes a low-voltage bobbin, a high-voltage bobbin, low-voltage winding, and high-voltage winding, each of which having a flattened substantially circular cross-section. The high-voltage winding is wound so as to have a film-layer winding structure. Diodes are provided such that each diode is coupled between two corresponding winding elements provided in the layers. A high-voltage capacitor and a high-voltage resistance substrate are connected to the output of the high-voltage winding. The diodes, the high-voltage capacitor, and the high-voltage resistance substrate are arranged in the longitudinal direction of the flattened substantially circular cross-section of the winding portion.

19 Claims, 8 Drawing Sheets

PRIORT ART

FLYBACK TRANSFORMER

BACKGROUND OF THE INVENTION

1. Field of the Invention

The present invention generally relates to flyback transformers, and more particularly, to a flyback transformer for supplying a high voltage to devices, such as a CRT (cathode ray tube) and other displays, that require a high voltage of about 5 kV or more.

2. Description of the Related Art

FIGS. 10 and 11 are schematic diagrams illustrating an example of a winding portion for use in a conventional flyback transformer. A winding portion 1 includes a cylindrical low-voltage bobbin 2 and a cylindrical high-voltage bobbin 3. A low-voltage winding 4 is wound around the low-voltage bobbin 2, and a high-voltage winding 5 is wound around the high-voltage bobbin 3. The high-voltage winding 5 is wound so as to have, for example, a film-layer winding structure. The high-voltage winding 5 is constituted by a plurality of winding elements (not shown) provided in corresponding layers, and diodes 6 are arranged such that each diode 6 is coupled between two corresponding winding elements provided in layers. A core is inserted into the low-voltage bobbin 2 to provide a closed magnetic path. The shape of the core inside the low-voltage bobbin 2 is cylindrical so as to correspond to the shape of the low-voltage bobbin 2. The winding portion 1 configured in such a manner is accommodated in a casing (not shown). Also accommodated in the casing are, for example, a high-voltage capacitor and a high-voltage resistance substrate which are connected to the output of the high-voltage winding 5.

In recent years, there has been a demand for compact and low-profile devices. A similar demand has been directed toward a flyback transformer, in particular, toward a low-profile flyback transformer. Conventional flyback transformers, however, cannot meet such a market demand.

SUMMARY OF THE INVENTION

In order to overcome the problems described above, preferred embodiments of the present invention provide a low-profile flyback transformer.

According to a preferred embodiment of the present invention, a flyback transformer includes a core having a flattened substantially circular cross-section, and first and second bobbins disposed around the core, with each bobbin having a flattened substantially circular cross-section. The flyback transformer further includes a low-voltage winding wound around the first bobbin, and a high-voltage winding wound around the second bobbin so as to have a film-layer winding structure.

Two opposing sides located in the width direction of the flattened substantially circular cross-section of each of the core and the first and second bobbins are preferably straight and two opposing sides located in the longitudinal direction of the flattened substantially circular cross-section thereof are preferably curved.

Each of the core and the first and second bobbins may have a substantially elliptical section.

Preferably, the high-voltage winding includes a plurality of winding elements and at least one diode. Each winding element is provided in a corresponding layer and the at least one diode is coupled between two corresponding winding elements. The at least one diode is preferably arranged at one side in the longitudinal direction of the flattened substantially circular cross-section.

The flyback transformer may further include a high-voltage capacitor that is connected to the output of the high-voltage winding. The high-voltage capacitor is preferably arranged at one side in the longitudinal direction of the flattened substantially circular cross-section.

The flyback transformer may further include a high-voltage resistance substrate that is connected to the output of the high-voltage winding. The high-voltage resistance substrate is preferably arranged at one side in the longitudinal direction of the flattened substantially circular cross-section.

Forming the core and bobbins to have flattened substantially circular cross-sections achieves a reduction in the width of the flattened substantially circular cross-sections. Thus, preferred embodiments of the present invention provide a low-profile flyback transformer, with respect to the width direction of the flattened substantially circular cross-sections.

In preferred embodiments of the present invention, two opposing sides located in the width direction of the flattened substantially circular cross-section are preferably straight and two opposing sides located in the longitudinal direction thereof are preferably curved.

Additionally, a substantially elliptical shape may be used for the flattened substantially circular cross-section.

Preferably, the diodes, each of which is connected to the corresponding winding element that is provided in a layer of the high-voltage winding having a film-layer winding structure, are preferably arranged at one side in the longitudinal direction of the flattened substantially circular cross-section of the core and bobbins. This allows the diodes to be arranged without increasing the width of the flattened substantially circular cross-section.

In addition, when the high-voltage capacitor and the high-voltage resistance substrate are accommodated in the same casing, they are arranged at one side in the longitudinal direction of the flattened substantially circular cross-section of the core and bobbins. This allows the elements to be arranged without increasing the width of the flattened substantially circular cross-section.

Accordingly, preferred embodiments of the present invention provide a flyback transformer that has a significantly reduced height and that has the same characteristic as a conventional flyback transformer having a winding portion with a perfect circular cross-section.

The above and other features, elements, characteristics and advantages of the present invention will become more apparent from the following detailed description of preferred embodiments thereof by referring to the accompanying drawings.

DETAILED DESCRIPTION OF PREFERRED EMBODIMENTS

Figure 1:
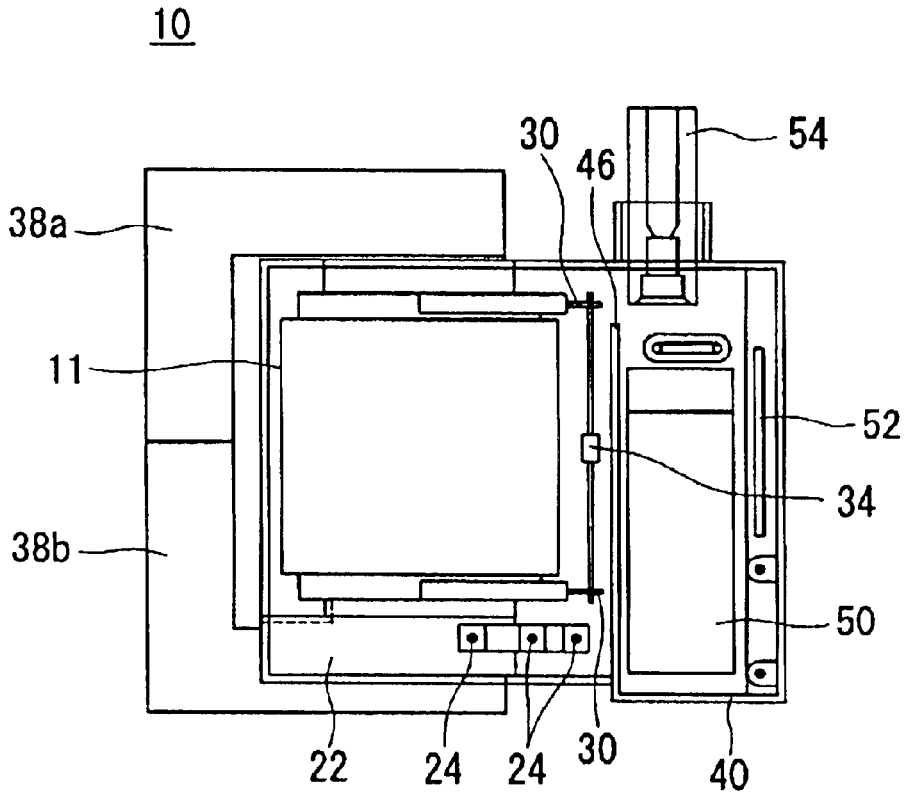
FIG. 1 is a plan view of a flyback transformer according to a preferred embodiment of the present invention.
Figure 2:
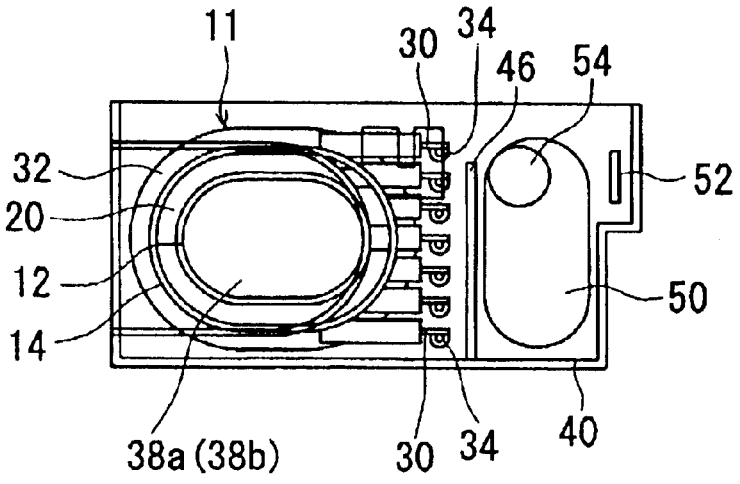
FIG. 2 is a side view of the flyback transformer according to the preferred embodiment of the present invention shown in FIG. 1.
Figure 3:
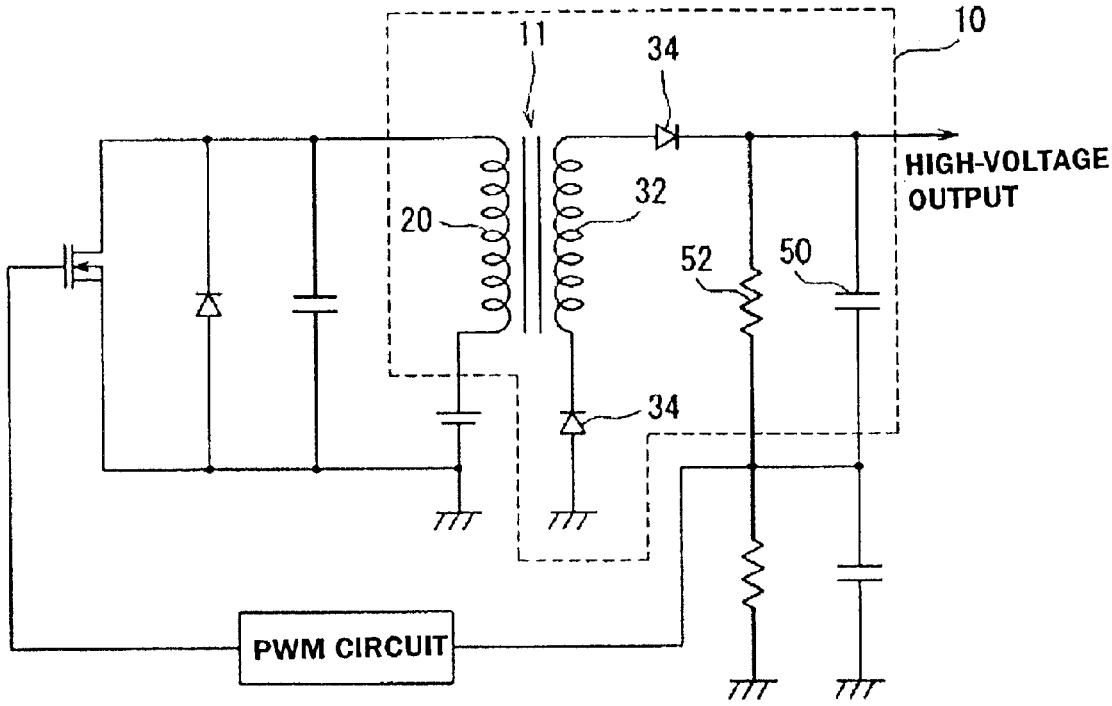
FIG. 3 is a circuit diagram of an example of a high-voltage power supply including the flyback transformer of the preferred embodiment of the present invention shown in FIG. 1.

FIG. 1 is a plan view of a flyback transformer according to a preferred embodiment of the present invention. FIG. 2 is a side view of the flyback transformer according to a preferred embodiment of the present invention. For example, the flyback transformer is used as a device that constitutes a high-voltage power supply for providing a CRT or other apparatus with a high voltage, as shown in FIG. 3.

Figure 4:
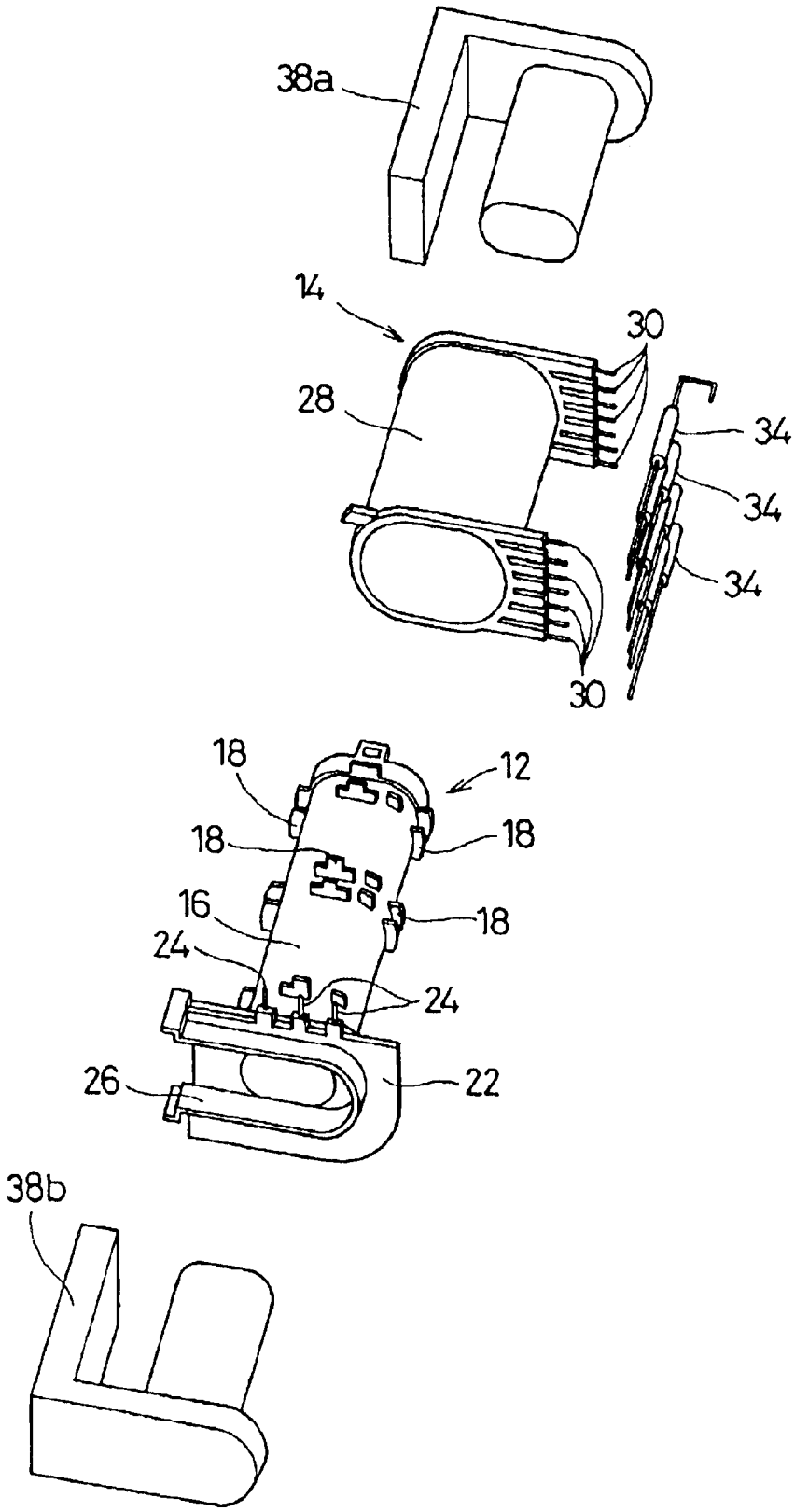
FIG. 4 is an exploded perspective view of a winding portion and core members for use in the flyback transformer of the preferred embodiment of the present invention shown in FIG. 1.
Figure 5:
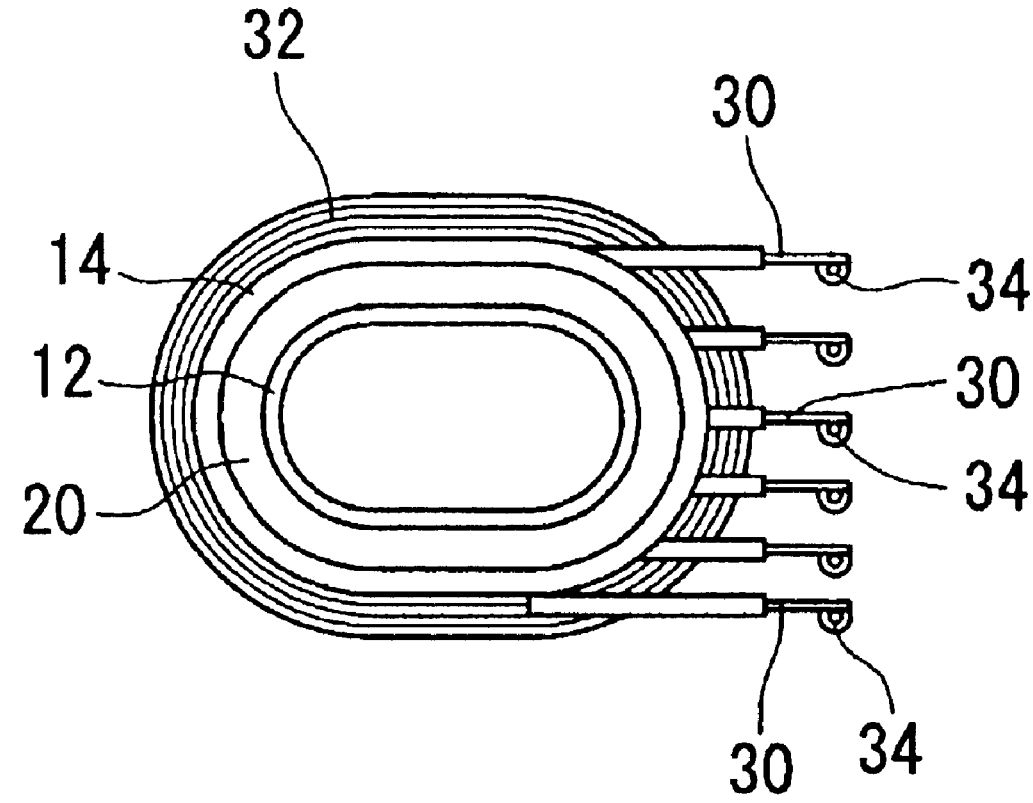
FIG. 5 is a sectional view of an example of the winding portion.

More specifically, a flyback transformer 10 includes a winding portion 11. The winding portion 11 includes a low-voltage bobbin 12 and a high-voltage bobbin 14. Preparing the low-voltage bobbin 12 and the high-voltage bobbin 14 separately and arranging them coaxially is essential for a high-voltage transformer to improve coupling and ensure insulation. As shown in FIG. 4, the low-voltage bobbin 12 includes a substantially cylindrical portion 16 having a flattened substantially circular cross-section. A plurality of tabs 18 is disposed on the outer periphery of the substantially cylindrical portion 16. As shown in FIG. 5, a low-voltage winding 20 is wound around the low-voltage bobbin 12 between the tabs 18. In addition, a base 22 is provided at one end of the low-voltage bobbin 12.

A plurality of terminals 24 is disposed at the base 22 in a direction that is substantially perpendicular to the axis direction of the substantially cylindrical portion 16. These terminals 24 are also arranged so as to extend in the width direction of a flattened substantially circular cross-section of the substantially cylindrical portion 16. The terminals 24 are connected to the low-voltage winding 20. A collar-like guide portion 26 is also disposed at the base 22 so as to substantially surround an opening, which has the flattened substantially circular cross-section, of the substantially cylindrical portion 16. That is, the guide portion 26 is preferably has a substantially U-shaped configuration such that one side in the longitudinal direction of the flattened substantially circular cross-section of the substantially cylindrical portion 16 is open. A core, which is described later, is accommodated in the guide portion 26.

The high-voltage bobbin 14 includes a substantially cylindrical portion 28 having a flattened substantially circular cross-section. The substantially cylindrical portion 28 is arranged to cover the outside of the low-voltage bobbin 12 around which the low-voltage winding 20 is wound. A plurality of terminals 30 is disposed at both longitudinal ends of the substantially cylindrical portion 28 in a direction that is substantially perpendicular to the axial direction of the substantially cylindrical portion 28. The terminals 30 are arranged so as to extend in the longitudinal direction of the flattened substantially circular cross-section of the substantially cylindrical portion 28. The high-voltage winding 32 is wound so as to have a film-layer winding structure. That is, the high-voltage winding 32 is constituted by a plurality of winding elements 32' that are provided in corresponding layers, each winding element 32' being coupled to the corresponding terminal 30. Diodes 34 are arranged such that each diode 34 is coupled between the corresponding terminals 30 provided at both ends of the high-voltage bobbin 14.

Figure 6:
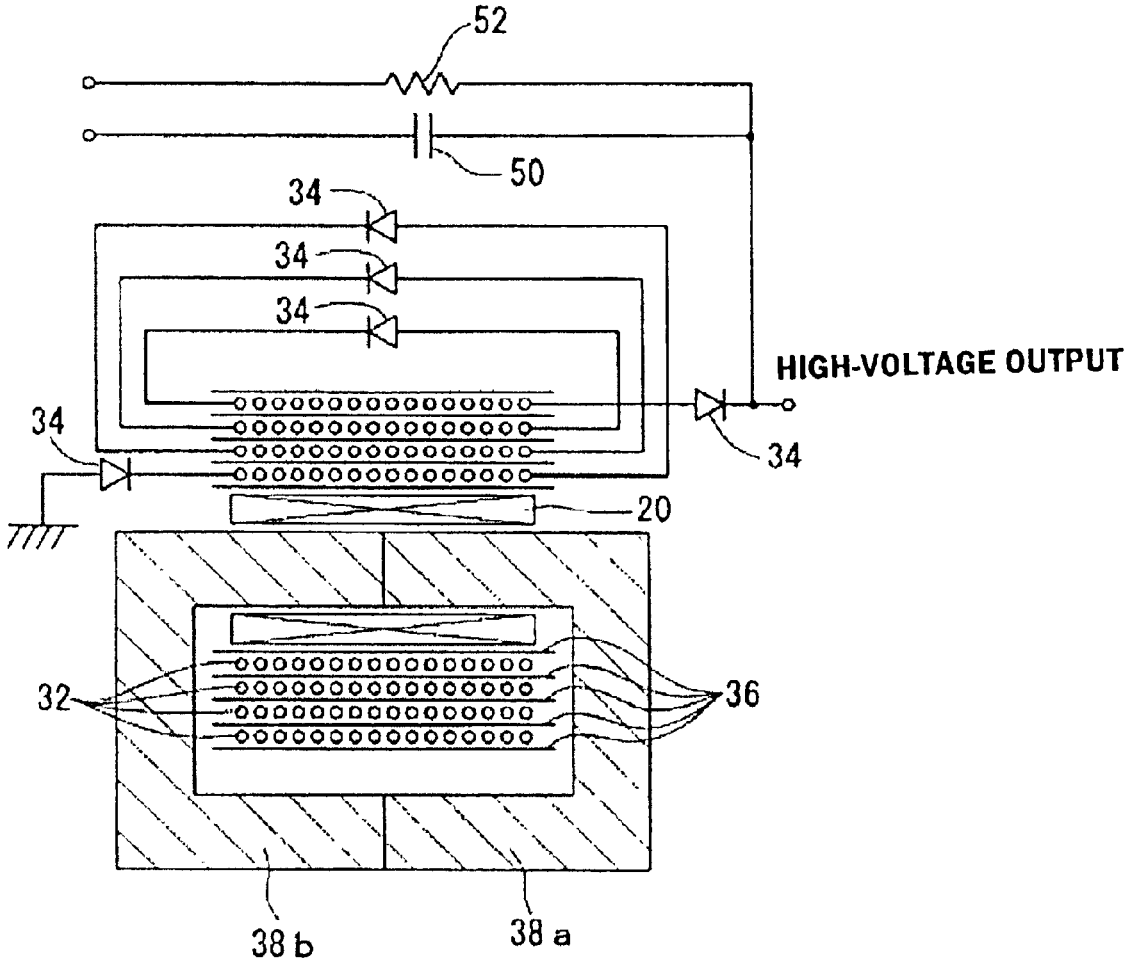
FIG. 6 is a schematic diagram illustrating a film-layer winding structure for a high-voltage winding for use in the winding portion.
Figure 7:
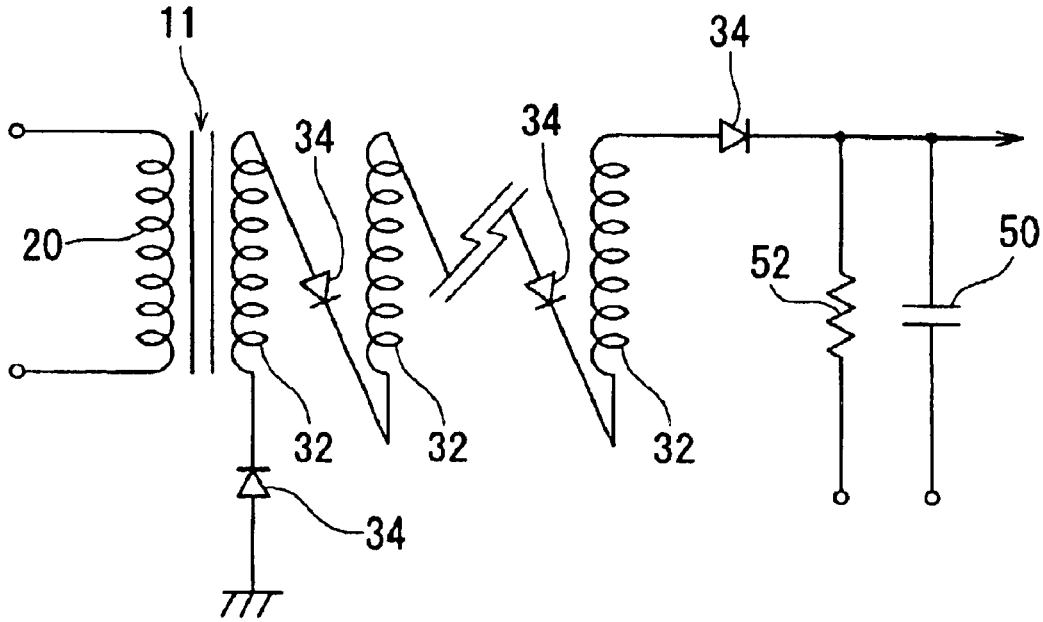
FIG. 7 is an equivalent circuit diagram of the high-voltage winding.

As shown in FIG. 6, the film-layer winding has a structure in which a winding element 32' is wound in a layer between corresponding insulating films 36 so as to provide an aligned densely-wound winding. The diodes 34 are coupled between the corresponding winding elements 32' provided in layers, and are coupled to both ends of the high-voltage winding elements 32. Thus, as shown in FIG. 7, the winding elements 32', which are provided in the corresponding layers, are wound in the same direction as the diodes 34 interposed therebetween. The diode 34 adjacent to the ground, however, does not necessarily have to be provided.

With the film-layer winding structure with the diodes 34 interposed therebetween, the winding elements 32' have substantially the same potential at corresponding positions in layers. This allows the use of significantly thin films for the insulating films 36. Furthermore, having substantially the same potentials at corresponding positions in layers allows a reduction in inter-layer distributed capacitance, which makes it possible to apply a high-voltage transformer to a higher frequency field. In addition, the film-layer winding eliminates the need for forming tabs for securing the creepage distance between winding elements 32', thus allowing a reduction in the overall thickness of the high-voltage winding 32. In FIG. 6, for clarity of the structure of the winding elements 32', the low-voltage bobbin 12 and the high-voltage bobbin 14 are not shown.

Figure 8:
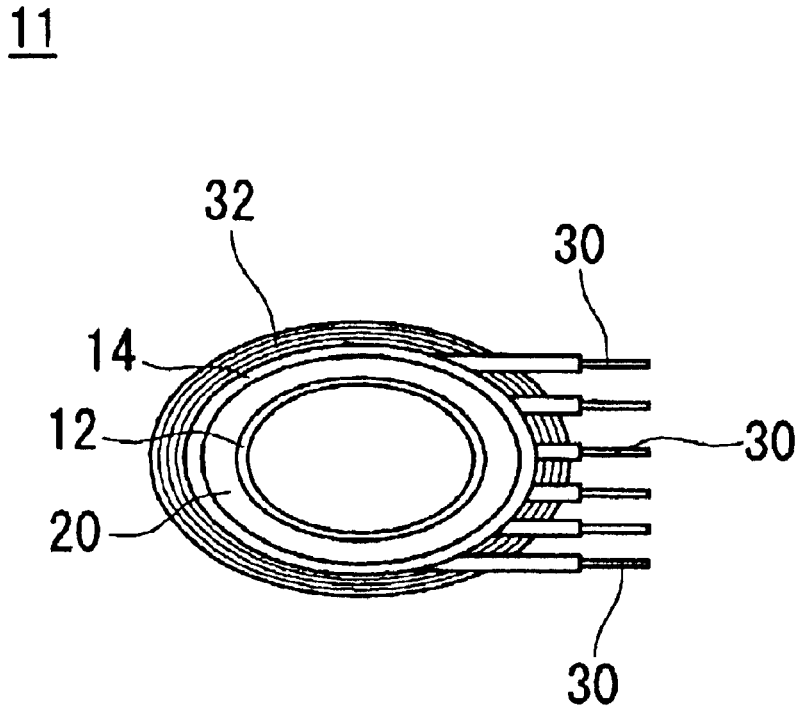
FIG. 8 is a sectional view of another example of the winding portion.

In addition, a core constituted by core members 38*a* and 38*b*, which have a substantially U-shaped configuration and are formed of a magnetic material, is inserted into the low-voltage bobbin 12. That is, the core members 38*a* and 38*b* are inserted from two opposing sides into the low-voltage bobbin 12 so as to abut each other at the approximate center thereof, as can be understood from FIG. 4. Portions, of the core members 38*a* and 38*b*, to be inserted into the low-voltage bobbin 12 are constructed to have flattened substantially circular cross-sections so as to correspond to the shape of the low-voltage bobbin 12. The low-voltage bobbin 12, the high-voltage bobbin 14, and the insertion portions of the core members 38*a* and 38*b* may be, as shown in FIG. 5, such that two opposing sides located in the width direction of the flattened substantially circular cross-section thereof are straight and two opposing sides located in the longitudinal direction thereof are curved. Alternatively, as shown in FIG. 8, the sectional shape thereof may be substantially elliptic.

Figure 9:
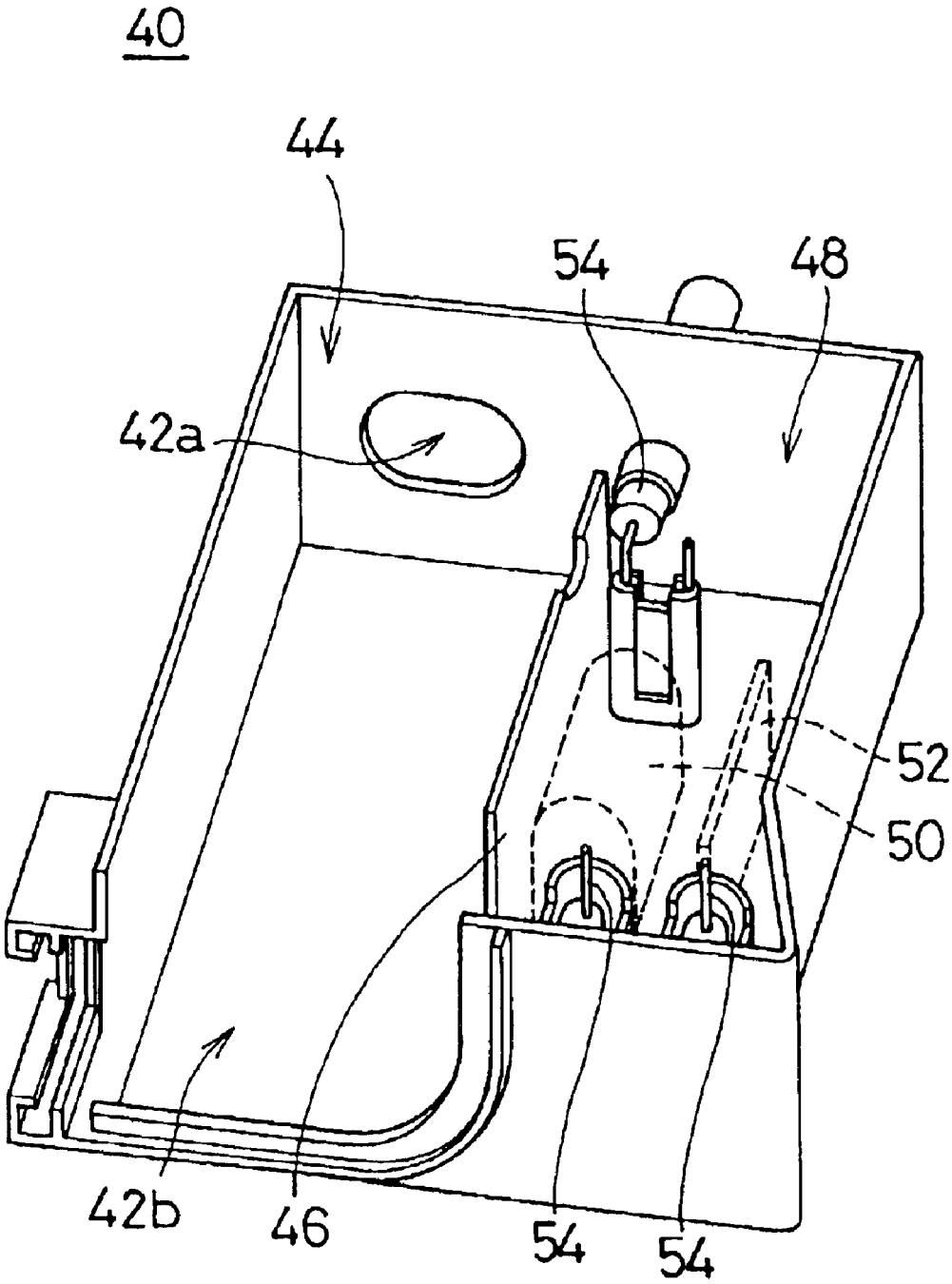
FIG. 9 is a perspective view of an example of a casing used for the flyback transformer of a preferred embodiment of the present invention.
Figure 10:
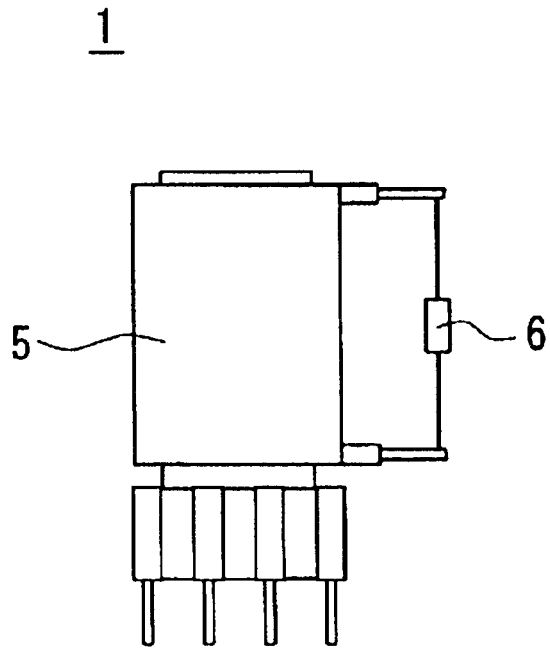
FIG. 10 is a view of an example of a winding portion for use in a conventional flyback transformer.

The low-voltage winding 20 and the high-voltage winding 32 are accommodated in a casing 40. As shown in FIG. 9, a winding accommodation portion 44 is disposed in the casing 40, and has, in two opposing surfaces thereof, openings 42*a* and 42*b* for insertion of the core members 38*a* and 38*b*, respectively. An electronic component accommodation portion 48 is located adjacent to the winding accommodation portion 44 with a partition wall 46 interposed therebetween. A high-voltage capacitor 50 and a high-voltage resistance substrate 52 are accommodated in the electronic component accommodation portion 48. Also provided in the electronic component accommodation portion 48 is a plurality of connection terminals 54 for connection with external circuits.

Inside the winding accommodation portion 44 of the casing 40, the low-voltage bobbin 12, the high-voltage bobbin 14, and the core members 38*a* and 38*b* are arranged such that the longitudinal diameter of the flattened substantially circular cross-section thereof is directed to the electronic component accommodation portion 48. Thus, the diodes 34, the high-voltage capacitor 50, and the high-voltage resistance substrate 52 are arranged in the longitudinal direction of the flattened substantially circular cross-section of the members of the winding portion 11. The casing 40 is mounted on a substrate (not shown) with the upper side in FIG. 9 facing downward.

Figure 11:
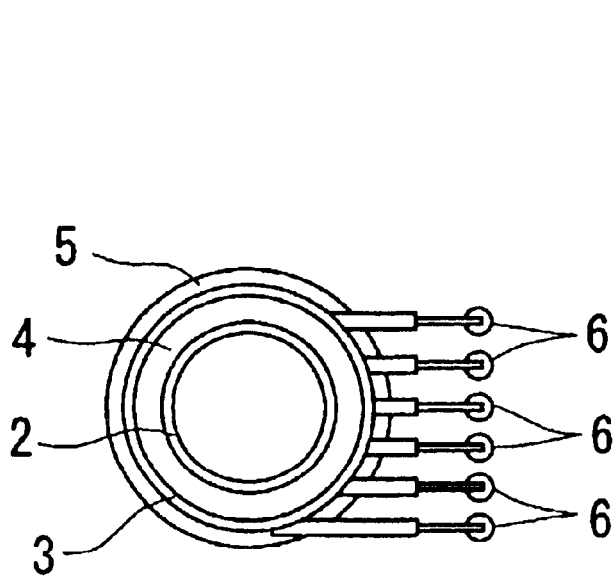
Fig. 11 PRIOR ART
FIG. 11 is a sectional view of an example of a winding portion for use in a conventional flyback transformer.

In the flyback transformer 10, the low-voltage bobbin 12, the high-voltage bobbin 14, and the portions of the core members 38*a* and 38*b*, to be inserted into the low-voltage bobbin 12 have flattened substantially circular cross-sections. The areas of the flattened substantially circular cross-sections are preferably substantially same as the areas of the perfect circular cross-sections of the corresponding members (see FIG. 11) designed according to the conventional manner. Forming the flattened substantially circular cross-sections in this manner can provide the same characteristic as a flyback transformer having the core and windings with the perfect circular cross-sections.

In the flyback transformer 10, constructing the cross-sectional shapes of the winding portion 11 and the core members 38*a* and 38*b* to have flattened substantially circular sections greatly reduces the thickness in the width direction. This allows a reduction in the thickness of the casing 40, which can achieve an overall low profile structure. Additionally, in the flyback transformer 10, since the high-voltage winding 32, which is constituted by a plurality of winding elements 32', is wound to have a film-layer winding structure and the diodes 34 are each provided between two corresponding winding elements 32' provided in layers, this arrangement can reduce the thickness of the high-voltage winding elements 32, and can also achieve an overall lower profile structure.

Additionally, in the flyback transformer 10, the diodes 34, the high-voltage capacitor 50, and the high-voltage resistance substrate 52 are arranged in the longitudinal direction of the flattened substantially circular cross-sections of the core members 38*a* and 38*b* and the winding portion 11. This arrangement, therefore, can prevent an increase in thickness which is due to the electronic components. In FIGS. 1 and 2, the diodes 34, the high-voltage capacitor 50, and the high-voltage resistance substrate 52 are arranged at the same side relative to the winding portion 11, but may be provided at different sides as long as they are arranged in the longitudinal direction of the flattened substantially circular cross-section of the winding portion 11.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A flyback transformer comprising:

a core having a flattened substantially circular cross-section;

first and second bobbins provided around the core, each of the first and second bobbins having a flattened substantially circular cross-section;

a low-voltage winding wound around the first bobbin; and high-voltage winding wound around the second bobbin so as to have a film-layer winding structure; wherein the flattened substantially circular cross-section of said core and said first and second bobbins has a dimensioning longitudinal direction that is greater than a dimension in a width direction; and at least one of a high-voltage capacitor and a high-voltage resistance substrate is connected to an output of the high-voltage winding, the at least one of the high-voltage capacitor and the high-voltage resistance substrate is adjacent to one side of said core and said first and second bobbins along the longitudinal direction of the flattened substantially circular cross-section such that a width dimension of the flyback transformer is not increased.

2. A flyback transformer according to claim 1, wherein two opposing sides located in the width direction of the flattened substantially circular cross-section of each of the core and the first and second bobbins are straight and two opposing sides located in the longitudinal direction of the flattened substantially circular cross-section thereof are curved.

3. A flyback transformer according to claim 1, wherein each of the core and the first and second bobbins has a substantially elliptical section.

4. A flyback transformer according to claim 1, wherein the high-voltage winding includes a plurality of winding elements and at least one diode, each winding element being provided in a corresponding layer, said at least one diode being coupled between two corresponding winding elements, and said at least one diode being arranged at one side in the longitudinal direction of the flattened substantially circular cross-section.

5. A flyback transformer according to claim 1, wherein both of the high-voltage capacitor and the high-voltage resistance substrate are connected to the output of the high-voltage winding, and both of the high-voltage capacitor and the high-voltage resistance substrate are adjacent to one side of said core and said first and second bobbins along the longitudinal direction of the flattened substantially circular cross-section.

6. A flyback transformer according to claim 1, wherein the first bobbin is a low voltage bobbin and the second bobbin is a high voltage bobbin.

7. A flyback transformer according to claim 1, wherein the second bobbin includes a substantially cylindrical portion and a plurality of tabs disposed on and extending outwardly from the outer periphery of the substantially cylindrical portion.

8. A flyback transformer according to claim 7, wherein the low-voltage winding is wound around the first bobbin between the plurality of tabs.

9. A flyback transformer according to claim 7, further comprising a base provided at one end of the first bobbin and a plurality of terminals disposed at the base and arranged to extend in a direction that is substantially perpendicular to the axis direction of the substantially cylindrical portion of the second bobbin.

10. A flyback transformer according to claim 9, wherein the terminals are arranged to extend in the width direction of a flattened substantially circular cross-section of the substantially cylindrical portion of the second bobbin.

11. A flyback transformer according to claim 9, wherein the terminals are connected to the low-voltage winding.

12. A flyback transformer according to claim 9, further comprising a guide portion disposed at the base so as to substantially surround an opening, which has the flattened substantially circular cross-section, of the substantially cylindrical portion of the second bobbin, wherein the guide portion has a substantially U-shaped configuration such that one side in the longitudinal direction of the flattened substantially circular cross-section of the substantially cylindrical portion of the second bobbin is open.

13. A flyback transformer according to claim 12, wherein the core is accommodated in the guide portion.

14. A flyback transformer according to claim 1, wherein the second bobbin includes a substantially cylindrical portion having a flattened substantially circular cross-section which is arranged to cover the outside of the first bobbin.

15. A flyback transformer according to claim 14, wherein a plurality of terminals is disposed at both longitudinal ends of the substantially cylindrical portion of the second bobbin in a direction that is substantially perpendicular to the axial direction of the substantially cylindrical portion of the second bobbin.

16. A flyback transformer according to claim 15, wherein the plurality of terminals is arranged so as to extend in the longitudinal direction of the flattened substantially circular cross-section of the substantially cylindrical portion of the second bobbin.

17. A flyback transformer according to claim 1, further comprising insulating films in the film-layer winding structure, wherein a winding element of the high voltage winding is wound in a layer between corresponding insulating films.

18. A flyback transformer according to claim 1, wherein the film layer winding structure including winding elements and the winding elements have substantially the same potential at corresponding positions in the layers of the film-layer winding structure.

19. A flyback transformer according to claim 1, wherein the core includes a plurality of core members having a substantially U-shaped configuration and being made of a magnetic material.

* * * * *